US005719110A

United States Patent [19]

Cook

[11] Patent Number: 5,719,110

[45] Date of Patent: Feb. 17, 1998

[54] CONTACT LENS CARE COMPOSITIONS WITH INOSITOL PHOSPHATE COMPONENTS

[75] Inventor: James N. Cook, Mission Viejo, Calif.

[73] Assignee: Allergan, Waco, Tex.

[21] Appl. No.: 696,759

[22] Filed: Aug. 14, 1996

[51] Int. Cl.[6] ..... C11D 3/386; C11D 3/36

[52] U.S. Cl. ..... 510/112; 510/113; 510/114; 510/382; 510/383; 510/462; 510/463; 510/468; 510/469; 435/264; 134/42

[58] Field of Search ..... 510/112, 113, 510/114, 382, 383, 461, 463, 468, 469; 435/264; 134/42

[56] References Cited

U.S. PATENT DOCUMENTS

| | | | |
|---|---|---|---|
| 4,285,738 | 8/1981 | Ogata | 134/26 |
| 4,401,582 | 8/1983 | Sherman | 510/275 |
| 4,731,192 | 3/1988 | Kenjo et al. | 510/113 |
| 4,793,945 | 12/1988 | Siren | 252/400.2 |
| 5,039,446 | 8/1991 | Estell | 510/321 |
| 5,041,236 | 8/1991 | Carpenter et al. | 510/131 |
| 5,238,304 | 8/1993 | Carpenter et al. | 510/131 |
| 5,238,843 | 8/1993 | Carpenter | 435/264 |
| 5,279,673 | 1/1994 | Dziabo et al. | 134/26 |
| 5,342,832 | 8/1994 | Siren | 514/101 |
| 5,356,803 | 10/1994 | Carpenter et al. | 435/200 |
| 5,395,541 | 3/1995 | Carpenter et al. | 510/363 |
| 5,422,073 | 6/1995 | Mowrey-McKee et al. | 422/28 |
| 5,576,028 | 11/1996 | Martin et al. | 424/613 |
| 5,607,698 | 3/1997 | Martin et al. | 424/613 |

*Primary Examiner*—Paul Lieberman
*Assistant Examiner*—Kery A. Fries
*Attorney, Agent, or Firm*—Frank J. Uxa

[57] ABSTRACT

Compositions and methods for caring for a contact lens include an inositol phosphate component in an amount effective to at least facilitate the beneficial treatment of the lens.

20 Claims, No Drawings

CONTACT LENS CARE COMPOSITIONS WITH INOSITOL PHOSPHATE COMPONENTS

BACKGROUND OF THE INVENTION

The present invention relates to compositions and methods for treating, for example, disinfecting, cleaning and soaking, contact lenses. More particularly, the invention relates to compositions including certain components useful in treating contact lens, for example, for disinfecting contact lenses, for removing proteinaceous deposit material from contact lenses and for soaking contact lenses.

Contact lenses need to be periodically treated, for example, disinfected, cleaned, soaked and the like, because of the tendency for a variety of microbes and other materials to accumulate on the lenses and/or the need to provide the lens suitable for safe and comfortable wear.

Although a number of effective contact lens treatment systems exist, there continues to be a need to provide new contact lens treatment systems that effect the desired treatment of the lens and/or provide the lens for safe and comfortable wear.

SUMMARY OF THE INVENTION

New compositions and methods for treating contact lenses have been discovered. The present compositions include an inositol phosphate component that preferably is soluble in a liquid aqueous medium and is present in the medium in an amount effective to facilitate the treatment of the contact lens, for example, to facilitate disinfecting the lens and/or to remove proteinaceous deposits from the contact lens.

Because the inositol phosphate component is often effective as a chelating agent, other components effective for such purpose, in particular ethylenediamine tetraacetic acid, such as the disodium salt thereof, (EDTA) and the like chelating agents, need not be present in the composition. The inositol phosphate components preferably enhance the antimicrobial activity of contact lens disinfecting compositions resulting, for example, in the use of reduced amounts of disinfectants and/or reduced cytotoxicity of the compositions. The presently useful inositol phosphate components advantageously reduce, or even substantially eliminate, the uptake of proteolytic enzymes, such as enzymes used in enzymatic contact lens cleaners. In addition, certain inositol phosphate components, for example, the calcium complex of phytic acid, very effectively, for example, during soaking of the contact lens, provide a desired supplement to the contact lens, for example, a calcium supplement, thus providing a nutrient source potentiating reduction of cytotoxicity of multi-purpose contact lens care solutions. The present compositions and methods are straightforward, and are easy to produce, use and practice.

In one broad aspect, the present invention is directed to compositions useful for treating, for example, disinfecting, cleaning, conditioning, soaking, storing and the like, a contact lens. The compositions comprise a liquid aqueous medium adapted to contact a contact lens in treating the lens, and an inositol phosphate component which preferably is soluble in the liquid aqueous medium. The inositol phosphate component is present in an amount effective to at least facilitate the treating of a contact lens contacted with the composition. Preferably, the composition is free of TYPE II endoglycosidase. In one very useful embodiment, the inclusion of an effective amount of an inositol phosphate component in a multi-purpose contact lens care solution enhances (increases) the passive contact lens cleaning ability of the composition relative to the multi-purpose solution without the inositol phosphate component. Further, the inclusion of an inositol phosphate component in a multi-purpose contact lens care solution preferably enhances (increases) the antimicrobial activity of the solution. To take advantage of this enhancement, the amount of the disinfectant component or components can be reduced, thus providing acceptable (adequate) antimicrobial activity while advantageously reducing the cytotoxicity of the multi-purpose solution.

A contact lens can be contacted with the inositol phosphate-containing medium in order to clean the lens without also contacting the lens with a disinfectant component.

In one embodiment of the invention, the compositions comprise a liquid aqueous medium, a disinfectant component, preferably a non-oxidative disinfectant component, in the liquid aqueous medium in an amount effective to disinfect a contact lens contacted with the composition, and an inositol phosphate component. The inositol phosphate component preferably is present in the liquid aqueous medium in an amount effective to remove proteinaceous deposit material from a contact lens contacted with the composition and/or in an amount effective to act as a chelating agent and/or in an amount effective to enhance the antimicrobial activity of the composition. The combination of a disinfectant, preferably non-oxidative disinfectant, and an inositol phosphate component preferably provides enhanced antimicrobial activity or efficacy relative to a similar composition without the inositol phosphate component. Further, such compositions preferably exhibit reduced cytotoxicity, for example, to eukaryotic cells, relative to similar compositions which include effective chelating amounts of EDTA instead of the inositol phosphate component. In a particularly useful embodiment, the present compositions are free of EDTA.

In a useful embodiment, the present compositions comprise at least one solid article (for example, a tablet, pill, pellet or a plurality of particles (such as granules)) that includes an inositol phosphate component soluble in a liquid aqueous medium, and an enzyme component effective to remove proteinaceous deposit material from a contact lens in an amount effective to remove proteinaceous deposit material from a contact lens contacted with a liquid medium, preferably a liquid aqueous medium, containing the composition in released form. Such compositions are preferably free of TYPE II endoglycosidase.

When used in combination with proteolytic enzymes, the presently useful inositol phosphate components preferably provide enhanced proteinaceous deposit material removal from a contact lens relative to using a similar composition without the inositol phosphate component. In addition, the inositol phosphate component preferably is effective to advantageously reduce, or even substantially prevent, the uptake of proteolytic enzyme component on the contact lens. This feature increases to safety and comfort or wearing enzymatically cleaned contact lenses.

Preferred inositol phosphate components for use in the invention include phytic acid; salts, preferably alkali metal and alkaline metal salts, of phytic acid; complexes, preferably alkaline earth metal complexes, of phytic acid; and the like and mixtures thereof.

In another broad aspect, methods for treating a contact lens are provided that employ the present compositions. Such methods comprise contacting the contact lens with a composition as described herein at conditions effective to provide the desired treatment to the contact lens, for example, to disinfect the lens and/or to remove proteinaceous material from the lens and/or to provide one or more other desired treatments to the lens. When the composition includes an above-described at least one solid article, the method comprises contacting a contact lens with a liquid aqueous medium combined with the composition at conditions effective to remove proteinaceous deposit material from the contact lens. During the contacting, the liquid medium may be subjected to agitation, such as by shaking the lens vial containing the liquid medium and contact lens, so as to at least facilitate the desired treatment of the lens, for example, by physically dislodging the deposits from the lens. In one embodiment, after contacting, the lens is manually rubbed at conditions effective to remove further deposit material from the lens. The methods can further comprise rinsing the contact lens substantially free of a composition of the invention, along with any dislodged lens deposit material.

Accordingly, compositions and methods of the invention can be used to treat contact lenses when provided in kits as solid articles, for example, tablets, or in liquid aqueous media, such as solutions. For instance, the compositions can be used in weekly protein removal systems or as contact lens disinfecting systems. The compositions can be used in combination with detergents, lubricants, wearability components, other contact lens care components, and the like, for example, in aqueous solutions therefore. The present invention can afford both disinfecting and cleaning of contact lenses in a single composition/step.

These and other aspects and advantages of the present invention will be apparent from the following detailed description and claims.

DETAILED DESCRIPTION OF THE INVENTION

The present invention is useful for treating, for example, cleaning, contact lenses. Any contact lens, for example, conventional hard contact lenses, rigid gas permeable contact lenses and soft contact lenses, can be treated in accordance with the present invention.

In one embodiment, the present compositions comprise a liquid aqueous medium, a disinfectant component, preferably a non-oxidative disinfectant component, in the liquid aqueous medium in an amount effective to disinfect a contact lens contacted with the composition, and an inositol phosphate component. The inositol phosphate component preferably is present in the liquid aqueous medium in an amount effective to remove proteinaceous deposit material from a contact lens contacted with the composition and/or in an amount effective to act as a chelating agent and/or in an amount effective to enhance the antimicrobial activity of the composition. The combination of a disinfectant, preferably a non-oxidative disinfectant, and an inositol phosphate component preferably provides enhanced antimicrobial activity or efficacy relative to a similar composition without the inositol phosphate component. Further, such compositions preferably exhibit reduced cytotoxicity, for example, to eukaryotic cells, relative to similar compositions which include effective chelating amounts of EDTA instead of the inositol phosphate component. In a particularly useful embodiment, the present compositions are free of EDTA.

The inositol phosphate component is preferably soluble in the liquid aqueous medium, and preferably is ophthalmically acceptable in the liquid aqueous medium. The compositions preferably are free of TYPE II endoglycosidase. In one embodiment, the present compositions are substantially free of cleaning enzyme components, such as the proteolytic enzymes conventionally used to remove proteinaceous deposit material from contact lenses.

A liquid aqueous medium or other material is "ophthalmically acceptable" when it is compatible with ocular tissue, that is, it does not cause significant or undue detrimental effects when brought into contact with ocular tissue. Preferably, the ophthalmically acceptable material is also compatible with other components of the present compositions.

When used in combination with proteolytic enzymes, the presently useful inositol phosphate components preferably provide enhanced proteinaceous deposit material removal from a contact lens relative to using a similar composition without the inositol phosphate component. In addition, the inositol phosphate components preferably are effective to advantageously reduce, or even substantially prevent, the uptake of proteolytic enzyme component on the contact lens. This feature increases to safety and comfort or wearing enzymatically cleaned contact lenses.

The presently useful inositol phosphate components are, in general, selected from compounds and complexes and other forms including a phosphate substituted inositol moiety and/or such a moiety which further includes one or more other substituents. All isomers and other forms of such inositol phosphate components are included. The inositol phosphate component may be present as an acid, a salt, a complex and the like and mixtures thereof. Of course, the inositol phosphate component selected should function as described herein. The inositol phosphate component may include 1 to 6 phosphate groups per molecule or inositol (or substituted inositol) moiety. The other substituents noted above should be substantially non-interfering, that is should have no undue detrimental effect on the contact lens being treated and on the wearer of the treated contact lens. Examples of such other substituents include, but are not limited to, ophthalmically acceptable substituents such as halide, sulfate, nitrate, acetate and the like. Inositol phosphate components which are free of such other substituents are particularly useful.

Phytic acid is present in different grains in varying amounts. The salts and complexes of phytic acid can be produced using conventional and well known techniques. Other inositol phosphate components are naturally occurring. The desired inositol phosphate component can be synthetically derived, for example, by enzymatic degradation of phytic acid and/or a salt thereof followed by separation such as chromatography, and purification. Such a synthesis is described in some detail in Siren U.S. Pat. No. 4,793,945, the disclosure of which is hereby incorporated in its entirety herein by reference.

Preferred inositol phosphate components for use in the invention include phytic acid; salts, preferably alkali metal and alkaline metal salts of phytic acid; complexes, preferably alkaline earth metal complexes, of phytic acid; and the like and mixtures thereof. One example of a useful inositol phosphate component is the calcium, magnesium complex of phytic acid, which is known as phytin and is abundant in plants. The calcium complex of phytic acid provides a calcium supplement, thus providing a nutrient source potentiating reduction of cytotoxicity of multi-purpose contact lens care solutions. Therefore, the calcium complex of phytic acid is preferably included in such solutions in an amount effective to reduce cytotoxicity.

The amount of inositol phosphate component to be used in accordance with the present invention is such as to be effective to perform the desired function, that is to at least facilitate providing the desired treatment to the contact lens being treated. The specific amount of inositol phosphate component employed depends on a number of factors, for example, the specific inositol phosphate component and other components of the composition being employed, the specific desired contact lens treatment to be provided, the specific contact lens being treated, the state of the contact lens being treated and the like factors. Excessive amounts of inositol phosphate component are to be avoided as being wasteful and since such excessive amounts may adversely affect the ophthalmic acceptability of the liquid aqueous medium containing the component. In a particularly useful embodiment, the amount of inositol phosphate component is such so that 10 ml of a liquid aqueous medium contains about 0.005% to about 0.5% or about 1% (w/v) of the inositol phosphate component.

In a useful embodiment, the present compositions comprise at least one solid article (for example, a tablet, pill, pellet or a plurality of particles (such as granules)) that includes an inositol phosphate component soluble in a liquid aqueous medium, and an enzyme component effective to remove proteinaceous deposit material from a contact lens in an amount effective to remove proteinaceous deposit material from a contact lens contacted with a liquid medium, preferably a liquid aqueous medium, containing the composition in released form. Such compositions are preferably free of TYPE II endoglycosidase.

In one embodiment, the release of the inositol phosphate component and/or the cleaning enzyme component in the liquid aqueous medium can be delayed by the use of a delayed release or barrier component.

The barrier component may be provided by coating a core tablet, pill, granules or other particle or particles or the like, containing the inositol phosphate component with a slow dissolving coating material, which may ultimately be completely or only partially soluble in the liquid aqueous medium. The delayed exposure form of the inositol phosphate component and/or the cleaning enzyme component preferably is such that substantially no effective exposure of the inositol phosphate component and/or the cleaning enzyme component to the liquid aqueous medium occurs during the delay period followed by rapid and substantially complete exposure of the inositol phosphate component and/or the cleaning enzyme component at the end of or after the delay period.

Barrier components suitable as either coatings or as matrices, include water soluble vinyl polymers, such as polyvinylpyrrolidone, polyvinylalcohol and polyethyleneglycol; water soluble proteins; polysaccharide and cellulose derivatives, such as methyl cellulose, hydroxypropylmethyl cellulose, sodium carboxymethyl cellulose; alginic acid and its salts and other derivatives; and the like and mixtures thereof.

Although multi-layered (including core and coating layers) tablets or pills are preferred, the liquid delayed release form of the present compositions can be present in any other suitable item or items, such as masses of powders, granules and the like. Delayed release technology which may be employed to provide for delayed exposure of the inositol phosphate component is well known in the art as exemplified by the text *Controlled Drug Delivery*, 2nd Ed., Joseph R. Robinson & Vincent H. L. Lee, Eds., Marcel Dekker, Inc., New York, 1987.

The amount of barrier component used is not critical in the present invention provided that such barrier component functions as described herein. The barrier component or components may suitably be present in the range of about 1% or about 5% to about 1000% or more, based on the weight of the inositol phosphate component and/or cleaning enzyme component.

The present solid compositions may be produced using any one of many suitable methods, a number of which are conventional and well known in the art. The production method chosen depends, in large measure, on the desired form of the composition. For example, the at least one item can be molded or cut or otherwise shaped into the desired form.

The present compositions may comprise a disinfectant component. The amount of the disinfectant component present in the liquid aqueous medium is effective to disinfect a contact lens placed in contact with the composition.

When a disinfectant component is desired to be included in an instant composition, it may be oxidative or non-oxidative.

Particularly useful oxidative disinfectant components are hydrogen peroxide and/or one or more other peroxy-containing compounds, for example, one or more other peroxides.

For hydrogen peroxide, a 0.5% (w/v) concentration, for example, in an aqueous liquid medium is often effective as a disinfectant component. It is preferred to use at least about 1.0% or about 2.0% (w/v) hydrogen peroxide which concentrations reduce the disinfecting time over that of the 0.5% (w/v) peroxide concentration. No upper limit is placed on the amount of hydrogen peroxide which can be used in this invention except as limited in that the disinfectant component should have no substantial detrimental effect on the contact lens being treated or on the eye of the wearer of the treated contact lens. An aqueous solution containing about 3% (w/v) hydrogen peroxide is very useful.

So far as other peroxides are concerned, they should be used in effective disinfecting concentrations.

When an oxidative disinfectant is used in the present invention, a reducing or neutralizing component in an amount sufficient to chemically reduce or neuturalize substantially all of the oxidative disinfectant, for example, hydrogen peroxide, present is employed.

Such reducing or neutralizing components are preferably incorporated into the enzyme component-containing tablet. The reducing agent is generally any non-toxic reducing agent. Reducing components include SH (group)-containing water-soluble lower alcohols, organic amines and salts thereof, amino acids and di-or tripeptides, e.g., cysteine hydrochloride ethyl ester, gluthione, homocysteine, carbamoyl cysteine, cysteinylglycine, 2-mercaptopropionic acid, 2-mercaptopropionylglycine, 2-mercaptoethylamine hydrochloride, cysteine, n-acetylcysteine, beta mercaptoethanol, cysteine hydrochloride, dithiothreitol, dithioerythritol, sodium bisulfate, sodium metabisulfite, thio urea, sulfites, pyrosulfites and dithionites such as the alkali metal salts or alkaline earth metal salts of sulfurous acid, pyrosulfurous acid and dithionious acid, e.g., lithium, sodium, calcium and magnesium salts and mixtures thereof. The thiols are preferred, with N-acetylcysteine being particularly useful.

In general, the reducing component is used in amounts in the range of about 0.5% to about 10% (w/v) of the liquid medium.

In one embodiment, all or a portion of the reducing component is replaced by a catalase component which acts to catalyze the neutralization or decomposition of the oxidative disinfectant component, such as hydrogen peroxide. Such catalase component can be included, for example, in the core of a barrier component coated tablet, in an amount effective to, together with the reducing component, if any, destroy or cause the destruction of all the oxidative disinfectant component present in the liquid medium. Some catalase component may be advantageously used to increase the rate at which the oxidative disinfectant component is destroyed.

The disinfectant component is preferably a substantially non-oxidative disinfectant component. As used herein, non-oxidative disinfectant components include effectively non-oxidative organic chemicals which derive their antimicrobial activity through a chemical or physiochemical interaction with the microbes or microorganisms. Suitable non-oxidative disinfectant components are those generally employed in ophthalmic applications and include, but are not limited to, quaternary ammonium salts used in ophthalmic applications such as poly[dimethylimino-2-butene-1,4-diyl] chloride, alpha-[4-tris(2-hydroxyethyl) ammonium]-dichloride (chemical registry number 75345-27-6, available under the trademark Polyquaternium 1® from Onyx Corporation), benzalkonium halides, and biguanides such as salts of alexidine, alexidine-free base, salts of chlorhexidine, hexamethylene biguanides and their polymers, antimicrobial polypeptides, and the like and mixtures thereof. A particularly useful substantially non-oxidative disinfectant component is selected from one or more (mixtures) of tromethamine (2-amino-2-hydroxymethyl-1, 3 propanediol), polyhexamethylene biguanide (PHMB), N-alkyl-2-pyrrolidone, chlorhexidine, Polyquaternium-1, hexetidine, bronopol, alexidine, very low concentrations of peroxide, ophthalmically acceptable salts thereof, and the like.

The salts of alexidine and chlorhexidine can be either organic or inorganic and are typically disinfecting gluconates, nitrates, acetates, phosphates, sulphates, halides and the like. Generally, the hexamethylene biguanide polymers, also referred to as polyaminopropyl biguanide (PAPB), have molecular weights of up to about 100,000. Such compounds are known and are disclosed in U.S. Pat. No. 4,758,595.

The non-oxidative disinfectant components useful in the present invention are preferably present in the liquid aqueous medium in concentrations in the range of about 0.00001% to about 2% (w/v).

More preferably, the non-oxidative disinfectant component is present in the liquid aqueous medium at an ophthalmically acceptable or safe concentration such that the user can remove the disinfected lens from the liquid aqueous medium and thereafter directly place the lens in the eye of safe and comfortable wear. The inclusion of an inositol phosphate component in a contact lens disinfecting composition preferably enhances the antimicrobial activity of the composition. In this situation it may be desirable to reduce the concentration or amount of disinfectant component so that the resulting composition still has acceptable or adequate antimicrobial activity to disinfect a contact lens and, in addition, advantageously has reduced cytotoxicity relative to the original composition without the inositol phosphate component.

When a contact lens is desired to be disinfected by a disinfectant component, an amount of disinfectant effective to disinfect the lens is used. Preferably, such an effective amount of the disinfectant reduces the microbial burden on the contact lens by one log order, in three hours. More preferably, an effective amount of the disinfectant reduces the microbial load by one log order in one hour.

The disinfectant component in accordance with the present invention is preferably provided in the liquid aqueous medium, and is more preferably soluble in the liquid aqueous medium.

As an alternate to the use of chemical disinfectants, the contact lens may be thermally disinfected, for example, while in a liquid aqueous medium containing an inositol phosphate component, as described herein. Subjecting a contact lens to elevated temperatures, for example, on the order of about 60° C. to about 100° C., for a period of time, for example, on the order of about 0.3 hours to about 2 hours or more, is effective to disinfect the lens.

The present compositions may further comprise effective amounts of one or more additional components, such as an additional cleaning component, for example, a detergent or surfactant component, an enzyme component and the like; a conditioning component; a wetting component; a wearability component, a buffer component, a tonicity adjustor component; and the like and mixtures thereof. The additional component or components may be selected from materials which are known to be useful in contact lens care compositions and are included in amounts effective to provide the desired effect or benefit. When an additional component is included, it is preferably compatible under typical use and storage conditions with the other components of the composition. For instance, when a disinfectant component is provided, the aforesaid additional component or components are preferably substantially stable in the presence of the disinfectant.

Each of the additional components, if any, may be present in either the solid or liquid form of the present compositions. When the additional component or components are present as a solid, they can either be intimately admixed such as in a powder or compressed tablet or they can be substantially separated, although in the particles, as in an encapsulated pellet or tablet. When the combination of inositol phosphate component and additional component or components is in liquid form, they are typically soluble in the liquid aqueous medium. One or both of the inositol phosphate component and the additional component or components can be in solid form until desired to be used, whereupon they can be dissolved in the liquid aqueous medium in order to effectively contact the surface of a contact lens.

When an additional cleaning component is included in the present compositions, the cleaning component should be present in an amount effective to at least facilitate removing, and preferably effective to remove, debris or deposit material from a contact lens. Exemplary cleaning components include detergents or surfactants such as nonionic surfactants, for example, polysorbates (such as polysorbate 20-Trademark Tween 20), 4-(1, 1, 3, 3-tetramethylbutyl) phenol polymers (such as the polymer sold under the trademark Tyloxapol), ethylene oxide/propylene oxide block copolymers, glycolic esters of fatty acids and the like, anionic surfactants, for example, alkyl ether sulfates and the like, and mixtures thereof.

The amount of surfactant component, if any, present varies over a wide range depending on a number of factors, for example, the specific surfactant or surfactants being used, the other components in the composition and the like. Often the amount of surfactant is in the range of about 0.005% to about 0.1% or about 0.5% (w/v) of the liquid medium.

Cleaning enzymes may also be employed. A cleaning enzyme component can be provided in an amount effective to at least facilitate removing deposit material from the contact lens. Types of deposit material or debris which may be deposited on the lens include proteins, lipids, and carbohydrate-based or mucin-based debris. One or more types of debris may be present on a given lens.

The cleaning enzyme component employed may be selected from enzymes conventionally employed in the enzymatic cleaning of contact lenses. Among the preferred enzymes are proteases, lipases, and the like. Exemplary enzymes are described by Huth et al U.S. Pat. No. 32,672 RE and Karageozian et al U.S. Pat. No. 3,910,296, which disclosures are incorporated herein by reference.

Preferred proteolytic enzymes are those substantially free of sulfhydryl groups or disulfide bonds, the presence of which may react with active oxygen of the oxidative disinfectant, rendering the enzyme inactive. Metalloproteases, enzymes which contain a divalent metal ion, may also be used.

Yet a more preferred group of proteolytic enzymes are the serine proteases, such as those derived from Bacillus and Streptomyces bacteria and Aspergillus molds. Of this class of enzymes, still more preferred enzymes are those derived from alkaline proteases, generically referred to as subtilisin enzymes.

Other enzymes preferred for this application include pancreatin, trypsin, collaginase, keratinase, carboxylase, aminopeptidase, elastase, and aspergillopeptidase A and B, pronase E (from *S. griseus*) and dispase (from *Bacillus polymyxa*).

In one embodiment, a liquid aqueous medium containing such a cleaning enzyme component preferably has sufficient enzyme to provide about 0.001 to about 3 Anson units of activity, more preferably about 0.01 to about 1 Anson units, per single lens treatment. However, higher or lower amounts may be used. Moreover, since enzyme activity is pH dependent, the preferred pH range for an enzyme can be determined by the skilled practitioner.

A particularly noteworthy embodiment of the present compositions is substantially free of proteolytic enzyme. Such a formulation provides for effective contact lens cleaning without the need to rinse the lens after cleaning to free the lens of the enzyme.

Compositions of the invention can also include preservatives, stabilizers, color indicators of hydrogen peroxide decomposition, plasticizers, thickening agents and the like.

Acceptable effective concentrations for these additional components in the compositions of the invention are readily apparent to the skilled practitioner.

The liquid aqueous medium used is selected to have no substantial deleterious effect on the lens being treated, or on the wearer of the treated lens. The liquid medium is constituted to permit, and even facilitate, the instant lens treatment or treatments. The liquid aqueous medium advantageously has a pH in the range of about 5 or about 6 to about 8 or about 10, and an osmolality in the range of at least about 200 mOsmol/kg for example, about 300 or about 350 to about 400 mOsmol/kg. The liquid aqueous medium more preferably is substantially isotonic or hypertonic (for example, slightly hypertonic) and/or is ophthalmically acceptable. The liquid aqueous medium preferably includes an effective amount of a tonicity adjusting component to provide the liquid medium with the desired tonicity. The liquid aqueous medium of the present invention preferably includes a buffer component which is present in an amount effective to maintain the pH of the medium in the desired range. Such tonicity adjusting components and buffer components may be present in the liquid aqueous medium and/or may be introduced into the liquid aqueous medium. Among the suitable tonicity adjusting components that may be employed are those conventionally used in contact lens care products, such as various inorganic salts. Sodium chloride and the like are very useful tonicity adjusting components. Among the suitable buffer components or buffering agents that may be employed are those conventionally used in contact lens care products. The buffer salts are preferably alkali metal, alkaline earth metal, or ammonium salts. Particularly useful media are those derived from saline, e.g., a conventional saline solution, or buffered saline solution. In addition, the liquid aqueous media may include one or more other materials, for example, as described elsewhere herein, in amounts effective to treat the contact lens (for example, provide a beneficial property to the contact lens) contacted with such media.

Methods for treating a contact lens using the herein described compositions are included within the scope of the invention. Such methods comprise contacting a contact lens with such a composition at conditions effective to provide the desired treatment to the contact lens.

The contacting temperature is preferred to be in the range of about 0° C. to about 100° C., and more preferably in the range of about 10° C. to about 60° C. and still more preferably in the range of about 15° C. to about 30° C. Contacting at or about ambient temperature is very convenient and useful. The contacting preferably occurs at or about atmospheric pressure. The contacting preferably occurs for a time in the range of about 5 minutes or about 1 hour to about 12 hours or more.

The contact lens can be contacted with the liquid aqueous medium by immersing the lens in the medium. During at least a portion of the contacting, the liquid medium containing the contact lens can be agitated, for example, by shaking the container containing the liquid aqueous medium and contact lens, to at least facilitate removal of deposit material from the lens. After such contacting step, the contact lens may be manually rubbed to remove further deposit material from the lens. The cleaning method can also include rinsing the lens substantially free of the liquid aqueous medium prior to returning the lens to a wearer's eye.

The following non-limiting examples illustrate certain aspects of the present invention.

EXAMPLE 1

A solution having a pH of 7 is prepared by blending together the following components:

| | |
|---|---|
| Buffered Saline Solution | 1000 ml |
| Phytic Acid | 2000 mg |

10 ml of this solution is introduced into a lens vial containing a proteinaceous deposit laden contact lens. The contact lens is maintained in this solution at room temperature is for about 10 hours.

After this time, the lens is removed from the solution and is placed in the lens wearer's eye for safe and comfortable wear. It is found that a substantial portion of the proteinaceous deposits previously present on the lens has been removed. For example, when compared to soaking in the buffered saline alone, the above-noted phytic acid-containing solution showed a 54% increase in the removal of lysozyme from the matrices of commercially available hydrogel contact lenses (sold by Johnson & Johnson under the trademark Surerue) in a 4 hour static soak.

Alternatively, after the 10 hour period of time, the lens is removed from the solution and rinsed with a quantity of the buffered saline solution without the phytic acid before being placed in the lens wearer's eye for safe and comfortable wear. Again, it is found that a substantial portion of the proteinaceous deposits previously present on the lens has been removed.

EXAMPLE 2

Example 1 is repeated except that after the 10 hour period of time the lens is removed from the solution, manually rubbed and rinsed with a quantity of the buffered saline solution without the phytic acid. The lens is then placed in the lens wearer's eye for safe and comfortable wear.

EXAMPLE 3

Example 1 is repeated except that after 5 hours and at the end of the 10 hour period of time the vial is shook (which facilitates dislodging deposit material from the lens surface). After the 10 hour period of time, the lens is removed from the solution and rinsed with an additional quantity of the buffered saline solution without the phytic acid. The lens is then placed in the lens wearer's eye for safe and comfortable wear.

EXAMPLE 4

Example 1 is repeated except that the solution further includes an effective amount of a conventional detergent, such as polysorbate 20.

After the 10 hour period of time, the lens is removed from the solution and is placed in the lens wearer's eye for safe and comfortable wear. It is found that a substantial portion of the proteinaceous deposits previously present on the lens has been removed. Also, the lens has enhanced wettability (by the fluids in the eye) as a result of the detergent in the solution. Alternatively, after the 10 hour period of time, the lens is removed from the solution and rinsed with a quantity of the solution without the phytic acid before being placed in the lens wearer's eye for safe and comfortable wear. Again, it is found that a substantial portion of the proteinaceous deposits previously present on the lens has been removed and that the lens has enhanced wettability (by the fluids in the eye) as a result of the detergent in the solution.

EXAMPLE 5

Example 4 is repeated except that after the 10 hour period of time the lens is removed from the solution, manually rubbed and rinsed with a quantity of the solution without the phytic acid. The lens is then placed in the lens wearer's eye for safe and comfortable wear. Also, the lens has enhanced wettability (by the fluids in the eye) as a result of the detergent in the solution.

EXAMPLE 6

Example 4 is repeated except that after 5 hours and at the end of the 10 hour period of time the vial is shook (which facilitates dislodging deposit material from the lens surface). After the 10 hour period of time, the lens is removed from the solution and rinsed with an additional quantity of the solution without the phytic acid. The lens is then placed in the lens wearer's eye for safe and comfortable wear. The lens has enhanced wettability (by the fluids in the eye) as a result of the detergent in the solution.

EXAMPLE 7

A solution similar to that of Example 1 is prepared except that this solution included 3% (w/v) of hydrogen peroxide.

A coated tablet, having a core tablet surrounded by a coating is prepared in accordance with the teachings of Park et al U.S. Pat. No. 5,145,644, the disclosure of which is incorporated in its entirety by reference herein. The tablet has the following composition.

| | |
|---|---|
| CORE TABLET: | |
| Crystalline catalase[1] | 1.5 mg |
| Sodium chloride | 89.4 mg |
| Dibasic sodium phosphate (anhydrous) | 12.5 mg |
| Monobasic sodium phosphate monohydrate | 0.87 mg |
| Polyethylene glycol (molecular weight of about 3350) | 1.05 mg |
| COATING: | |
| Hydroxypropylmethyl cellulose | 3 to 6 mg |

[1]The amount of catalase added was determined by an assay of the batch of product to be used. The tablet prepared contained about 5200 units of catalase activity.

A quantity of 10 ml of the hydrogen peroxide-containing solution is placed in a conventional contact lens vial. A pair of contact lenses are placed in a conventional holder and the holder is placed in the vial so that the lenses are immersed in the solution. At substantially the same time, the coated tablet is placed in the vial.

After a period of time, on the order of about 30 minutes, the material in the vial begins to bubble. This indicates that the catalase has been released from the coated tablet in the liquid medium and is causing the destruction of hydrogen peroxide. After about 45 minutes, the bubbling stops. The contact lenses are left to soak in the remaining solution for an additional 6 hours.

It is found that the contact lens has been disinfected and that deposit material originally present on the lens has been removed. The lenses are removed from the vial and holder and are placed directed into the eyes of a human being for safe and comfortable wear.

EXAMPLE 8

A solution similar to that of Example 1 is prepared. This solution further includes 0.01% by weight of a non-oxidative antimicrobial component, such as the agent sold by Onyx Corporation under the trademark Polyquaternium-1.

10 ml of this solution is introduced into a vial containing a contact lens. The lens is maintained in this solution at room temperature overnight, that is for about 10 hours.

After this time, the lens is removed from the solution and is placed in the lens wearer's eye for safe and comfortable wear. It is found that the lens is disinfected during the 10 hours. Alternatively, after the 10 hour period of time, the lens is removed from the solution and rinsed with a quantity of buffered saline solution before being placed in the lens wearer's eye for safe and comfortable wear. Again, it is found that the lens is disinfected during the 10 hours.

EXAMPLE 9

Another solution similar to that of Example 1 is prepared. This solution further includes 0.01% by weight of polyhexamethylene biquanide.

10 ml of this solution is introduced into a lens vial containing a contact lens. The lens is maintained in the solution at room temperature for about 12 hours.

After this time, the lens is removed from the solution and is placed in the lens wearer's eye for safe and comfortable wear. It is found that the lens is disinfected during the 12 hours. Alternatively, after the 12 hour period of time, the lens is removed from the solution and rinsed with a quantity of buffered saline solution before being placed in the lens wearer's eye for safe and comfortable wear. Again, it is found that the lens is disinfected during the 12 hours.

EXAMPLE 10

A tablet having the following composition is prepared by compressing a mixture of powders having the same chemical make-up using conventional compression tableting techniques:

| | |
|---|---|
| Phytic Acid | 20 mg |
| Subtilisin A | 0.017 Anson Units |
| Anhydrous Sodium Carbonate | 12 mg |
| Tartaric Acid | 15 mg |
| Filler | 20 mg |

EXAMPLE 11

Example 9 is repeated using a proteinaceous deposit laden contact lens and placing the tablet of Example 10 in the lens vial immediately prior to introducing the solution in the vial.

After about a 12 hour period of time, the lens is removed from the solution and is placed in the lens wearer's eye for safe and comfortable wear. It is found that the lens is disinfected during the 12 hours and that a substantial portion of the proteinaceous deposits previously present on the lens has been removed. Alternatively, after the 12 hour period of time, the lens is removed from the solution and rinsed with a quantity of buffered saline solution before being placed in the lens wearer's eye for safe and comfortable wear. Again, it is found that the lens is disinfected during the 12 hours and that a substantial portion of the proteinaceous deposits previously present on the lens has been removed.

The disinfected/cleaned lens advantageously retains less Subtilisin A enzyme relative to treating a similar lens in accordance with a similar methodology without the use of phytic acid.

EXAMPLE 12

The following composition is prepared by blending the components together:

| | |
|---|---|
| 2-amino-2-hydroxymethyl-1,3-propanediol (Tromethamine) | 1.2% (w/v) |
| Disodium EDTA | 0.05% (w/v) |
| Phytic acid | 0.1% (w/v) |
| Polyhexamethylene biguanide (PHMB) | 0.0001% (w/v) |
| Hydrochloric acid/sodium hydroxide | to pH 7.5 |
| 4-(1,1,3,3-tetramethylbutyl)-phenol polymer with formaldehyde and oxirane (Tyloxapol) | 0.0250% (w/v) |
| Purified water (USP) | q.s. To volume |

EXAMPLE 13

10 ml of the composition (solution) of Example 12 is introduced into a lens vial containing a contact lens. The lens is maintained in the solution at room temperature for about 12 hours.

After this time, the lens is removed from the solution and is placed in the lens wearer's eye for safe and comfortable wear. It is found that the lens is disinfected during the 12 hours. In addition, the lens is cleaner, that is has a reduced amount of material (for example, proteinaceous material) deposited on it relative to a similar lens subjected to a similar treatment using a similar composition without phytic acid. Thus the composition of Example 11 has outstanding passive contact lens cleaning ability.

Alternatively, after the 12 hour period of time, the lens is removed from the solution and rinsed with a quantity of buffered saline solution before being placed in the lens wearer's eye for safe and comfortable wear. Again, it is found that the lens is disinfected during the 12 hours.

EXAMPLE 14

A tablet having the following composition is prepared by compressing a mixture of powders having the same chemical make-up using conventional compression tableting techniques:

| | |
|---|---|
| Subtilisin A | 0.017 Anson Units |
| Anhydrous Sodium Carbonate | 12 mg |
| Tartarid Acid | 15 mg |
| Filler | 20 mg |

EXAMPLE 15

Example 13 is repeated using a proteinaceous deposit laden contact lens and placing the tablet of Example 14 in the lens vial immediately prior to introducing the solution in the vial.

After about a 12 hour period of time, the lens is removed from the solution and is placed in the lens wearer's eye for safe and comfortable wear. It is found that the lens is disinfected during the 12 hours and that a substantial portion of the proteinaceous deposits previously present on the lens has been removed. Alternatively, after the 12 hour period of time, the lens is removed from the solution and rinsed with a quantity of buffered saline solution before being placed in the lens wearer's eye for safe and comfortable wear. Again, it is found that the lens is disinfected during the 12 hours and that a substantial portion of the proteinaceous deposits previously present on the lens has been removed.

The disinfected/cleaned lens advantageously retains less Subtilisin A enzyme relative to treating a similar lens in accordance with a similar methodology without the use of phytic acid.

EXAMPLE 16

Example 12 is repeated except that no disodium EDTA is included, the amount of PHMB is reduced by 50% and the amount of phytic acid is increased to 0.2% (w/v).

EXAMPLE 17

10 ml of the composition (solution) of Example 16 is introduced into a lens vial containing a contact lens. The lens is maintained in the solution at room temperature for about 12 hours.

After this time, the lens is removed from the solution and is placed in the lens wearer's eye for safe and comfortable wear. It is found that the lens is disinfected during the 12 hours. The composition advantageously exhibits less cytotoxicity than the composition of Example 12. However, the antimicrobial activity and passive contact lens cleaning ability of this composition are as good or better than the composition of Example 11.

Alternatively, after the 12 hour period of time, the lens is removed from the solution and rinsed with a quantity of buffered saline solution before being placed in the lens wearer's eye for safe and comfortable wear. Again, it is found that the lens is disinfected during the 12 hours.

EXAMPLE 18

Example 17 is repeated using a proteinaceous deposit laden contact lens and placing the tablet of Example 13 in the lens vial immediately prior to introducing the solution in the vial.

After about a 12 hour period of time, the lens is removed from the solution and is placed in the lens wearer's eye for safe and comfortable wear. It is found that the lens is disinfected during the 12 hours and that a substantial portion of the proteinaceous deposits previously present on the lens has been removed. Alternatively, after the 12 hour period of time, the lens is removed from the solution and rinsed with a quantity of buffered saline solution before being placed in the lens wearer's eye for safe and comfortable wear. Again, it is found that the lens is disinfected during the 12 hours and that a substantial portion of the proteinaceous deposits previously present on the lens has been removed.

The disinfected/cleaned lens advantageously retains less Subtilisin A enzyme relative to treating a similar lens in accordance with a similar methodology without the use of phytic acid.

While this invention has been described with respect to various specific examples and embodiments, it is to be understood that the invention is not limited thereto, and that it can be variously practiced within the scope of the following claims.

What is claimed is:

1. A composition effective for disinfecting a contact lens comprising:

a liquid aqueous medium;

a disinfectant component present in said liquid aqueous medium in an amount effective to disinfect a contact lens contacted with said composition; and an inositol phosphate component present in said liquid aqueous medium in an amount effective to remove proteinaceous deposit material from a contact lens contacted with said composition, said composition being free of TYPE II endoglycosidase.

2. The composition of claim 1 wherein said inositol phosphate component is selected from the group consisting of phytic acid, salts of phytic acid, complexes of phytic acid and mixtures thereof.

3. The composition of claim 1 wherein said disinfectant component is a non-oxidative disinfectant.

4. The composition of claim 1 wherein said inositol phosphate is present in an effective chelating amount and said composition is free of EDTA.

5. The composition of claim 1 which further comprises a surfactant component in an amount effective to remove deposit material from a contact lens contacted with said composition.

6. A composition effective for disinfecting a contact lens comprising:

a liquid aqueous medium;

a disinfectant component present in said liquid aqueous medium in an amount effective to disinfect a contact lens contacted with said composition; and an inositol phosphate component present in said liquid aqueous medium in an amount effective to act as a chelating agent, said composition being free of TYPE II endoglycosidase.

7. The composition of claim 6 wherein said inositol phosphate component is selected from the group consisting of phytic acid, salts of phytic acid, complexes of phytic acid and mixtures thereof.

8. The composition of claim 6 which further comprises a surfactant component in an amount effective to remove deposit material from a contact lens contacted with said composition.

9. The composition of claim 6 which is free of EDTA, and said disinfectant component is a non-oxidative disinfectant.

10. A composition effective for treating a contact lens comprising:

a liquid aqueous medium adapted to contact a contact lens in treating the contact lens; and an inositol phosphate component selected from the group consisting of phytic acid, salts of phytic acid, complexes of phytic acid and mixtures thereof present in said liquid aqueous medium in an amount effective to facilitate the treating of a contact lens contacted with said composition, said composition being free of TYPE II endoglycosidase.

11. The composition of claim 10 wherein said inositol phosphate component is present in an amount effective to facilitate removal of deposit material from a contact lens contacted with said composition.

12. The composition of claim 10 wherein which further comprises a surfactant component in an amount effective to remove deposit material from a contact lens contacted with said composition.

13. The composition of claim 10 which further comprises an enzyme component effective to remove proteinaceous deposit material from a contact lens contacted with said composition.

14. A composition comprising at least one solid article including an inositol phosphate component which is soluble in a liquid aqueous medium used to contact a contact lens in cleaning the contact lens and an enzyme component effective to remove proteinaceous deposit material from a contact lens in an amount effective to remove proteinaceous deposit material from the contact lens contacted with a liquid medium containing said composition in released form, said composition being free of TYPE II endoglycosidase.

15. The composition of claim 14 wherein said inositol phosphate component is selected from the group consisting of phytic acid, salts of phytic acid, complexes of phytic acid and mixtures thereof.

16. A method for disinfecting a contact lens comprising contacting contact lens with the composition of claim 1 at conditions effective to disinfect said contact lens.

17. A method for disinfecting a contact lens comprising contacting contact lens with the composition of claim 6 at conditions effective to disinfect said contact lens.

18. A method for treating a contact lens comprising contacting a contact lens with the composition of claim 10 at conditions effective to provide the desired treatment to said contact lens.

19. A method for cleaning a contact lens comprising contacting a proteinaceous deposit material-containing contact lens with a liquid aqueous medium combined with the composition of claim 14 at conditions effective to remove proteinaceous deposit material from said proteinaceous deposit material-containing contact lens.

20. A method for cleaning a contact lens comprising contacting a proteinaceous deposit material-containing contact lens with a composition comprising a liquid aqueous medium and an inositol phosphate component present in a solubilized form in said liquid aqueous medium in an amount effective to remove proteinaceous deposit material from a contact lens in contact with said composition, said contacting occurring at conditions effective to remove proteinaceous deposit material from said proteinaceous deposit-containing contact lens, said composition being free of TYPE II endoglycosidase.

* * * * *